US012722817B2

(12) United States Patent
Stefanelli

(10) Patent No.: US 12,722,817 B2
(45) Date of Patent: Sep. 1, 2026

(54) APPARATUS AND METHOD FOR AUTOMATICALLY FILLING AND WEIGHING CONTAINERS

(71) Applicant: I.M.A. INDUSTRIA MACCHINE AUTOMATICHE S.P.A., Ozzano Dell'Emilia (IT)

(72) Inventor: Gabriele Stefanelli, Ozzano Dell'Emilia (IT)

(73) Assignee: I.M.A. INDUSTRIA MACCHINE AUTOMATICHE S.P.A., Ozzano Dell'Emilia (IT)

( * ) Notice: Subject to any disclaimer, the term of this patent is extended or adjusted under 35 U.S.C. 154(b) by 0 days.

(21) Appl. No.: 19/151,412

(22) PCT Filed: Jan. 29, 2024

(86) PCT No.: PCT/IT2024/050021
§ 371 (c)(1),
(2) Date: Jul. 28, 2025

(87) PCT Pub. No.: WO2024/161433
PCT Pub. Date: Aug. 8, 2024

(65) Prior Publication Data

US 2026/0225746 A1 Aug. 6, 2026

(30) Foreign Application Priority Data

Jan. 30, 2023 (IT) ..... 102023000001356

(51) Int. Cl.
*B65B 3/00* (2006.01)
*B65B 3/28* (2006.01)
(Continued)

(52) U.S. Cl.
CPC ..... *B65B 3/28* (2013.01); *B65B 3/003* (2013.01); *B65B 43/46* (2013.01); *B65B 65/003* (2013.01)

(58) Field of Classification Search
CPC ..... B65B 3/28; B65B 3/003; B65B 43/46; B65B 65/003
See application file for complete search history.

(56) References Cited

U.S. PATENT DOCUMENTS 10,737,810 B2 * 8/2020 Franke ..... B65B 35/36
10,829,252 B2 * 11/2020 Trilli ..... B65B 55/027
(Continued)

FOREIGN PATENT DOCUMENTS

EP 3307629 B1 8/2019

OTHER PUBLICATIONS

International Search Report filed in PCT/IT2024/050021 filed Jan. 29, 2024.

*Primary Examiner* — Andrew M Tecco
(74) *Attorney, Agent, or Firm* — RANKIN, HILL & CLARK LLP

(57) ABSTRACT

An apparatus for automatically filling and weighing containers supported by a carrier member includes a first station for feeding the carrier member sequentially, a second station configured to fill and weigh the containers; a first robotic arm configured to selectively move one carrier member at a time, a second and a third robotic arm configured to receive respectively at least a first and a second carrier member from the first robotic arm and to move them between one or more operative positions.

15 Claims, 7 Drawing Sheets

(51) Int. Cl.
*B65B 43/46* (2006.01)
*B65B 65/00* (2006.01)

(56) References Cited

U.S. PATENT DOCUMENTS

| | | | | |
|---|---|---|---|---|
| 12,391,416 | B2 * | 8/2025 | Boerret | B65B 3/003 |
| 12,522,392 | B2 * | 1/2026 | Gabusi | B65B 3/003 |
| 2003/0056466 | A1 | 3/2003 | Muneyasu | |
| 2018/0162572 | A1 * | 6/2018 | Trilli | B65B 55/027 |
| 2018/0186481 | A1 * | 7/2018 | Franke | B65B 3/28 |
| 2023/0406554 | A1 * | 12/2023 | Boerret | B65B 3/003 |
| 2024/0025578 | A1 * | 1/2024 | L'Heryenat | B65B 43/50 |
| 2025/0002192 | A1 * | 1/2025 | Gabusi | B65B 3/003 |

* cited by examiner

APPARATUS AND METHOD FOR AUTOMATICALLY FILLING AND WEIGHING CONTAINERS

FIELD OF THE INVENTION

The present invention concerns an apparatus and a method for automatically filling and weighing containers, such as for example vials, bottles, flasks, or other types of containers, capable of containing fluid products, in particular liquids, solid, powder, or gel products. By way of example, the apparatus can be used in the pharmaceutical, cosmetic, health, chemical and/or food fields.

BACKGROUND OF THE INVENTION

In the industrial sector of automated packaging of containers, filling and weighing apparatuses are known which have one or more work stations placed on a work path, along which the containers are moved in sequence. Such known apparatuses can be part of more complex machines, which also comprise other apparatuses, or zones, for working the aforementioned containers.

The movement of the containers between the different work stations can occur either by means of traditional mechanical and motorized movement means or devices which comprise, for example, conveyor belts, gears, chains, slides and/or lifters, or by means of anthropomorphic mechanical arms, or robotic arms.

An apparatus for automatically filling containers, in particular bottles, cartridges, syringes or other, is known from document EP 3.307.629 B1.

An apparatus is also known that comprises a first station in which the empty containers are fed, a second station in which the containers are filled and weighed, and a third station in which the containers are closed and prepared for a subsequent distribution step. Typically, containers arrive in the first station supported by special container-carrying trays, which are provided with a plurality of housing seats suitable to accommodate them.

The second station usually comprises a weighing unit, a filling unit, and one or more robotic arms for moving one tray at a time from one unit to another in order to perform, cyclically, the operations of weighing the empty containers, and filling and weighing the filled containers.

The use of robotic arms for moving the trays is advantageous compared to traditional movement means or devices, since they can be cleaned and sanitized very easily. This is particularly advantageous when the apparatus has to operate in hygienically safe work environments, for example in sanitized or sterilized environments.

However, one disadvantage of this known apparatus is that, since it is particularly compact, during the filling and weighing operations the robotic arms move above the containers, entailing the risk that dust and/or particulate may fall into the same containers, still open and not capped.

There is therefore the need to perfect an apparatus for automatically filling and weighing containers that can overcome at least one of the disadvantages of the state of the art.

To do this, it is necessary to solve at least the technical problem of providing an apparatus for automatically filling and weighing containers that is able to minimize, or completely eliminate, the risk that dusts and/or particulate originating from the movement of the robotic arms may fall inside the containers, while ensuring that the hygiene and cleanliness conditions of the work environment are maintained, and keeping a compact structure.

In particular, one purpose of the present invention is to provide an apparatus and to develop a method for automatically filling and weighing containers, which allow to have a high productivity, reaching values comparable to, or higher than, those that can be achieved with the aforementioned traditional movement means or devices.

Another purpose of the present invention is to provide an apparatus and to develop a method for automatically filling and weighing containers, which is compact, highly efficient and which allows to maintain the conditions of hygiene and cleanliness of the work environment.

The Applicant has devised, tested and embodied the present invention to overcome the shortcomings of the state of the art and to obtain these and other purposes and advantages.

SUMMARY OF THE INVENTION

The present invention is set forth and characterized in the independent claims. The dependent claims describe other characteristics of the present invention or variants to the main inventive idea.

In accordance with the above purposes and to resolve the technical problem disclosed above in a new and original way, also achieving considerable advantages compared to the state of the prior art, a method has been embodied for automatically filling and weighing containers supported by a carrier member which is fed at a first feeding station of an apparatus, the apparatus further comprising a second filling and weighing station, the method comprises at least a first and a second feeding step, wherein a first carrier member configured to support filled and weighted containers and a second carrier member configured to support to-be-filled and to-be-weighted containers are fed in the first station, to then be moved one at a time towards the second station by a first robotic arm of the apparatus; one or more picking up and weighing steps, wherein one or more to-be-filled containers are picked up from the second carrier member; and one or more inserting and weighing steps, wherein one or more filled containers are inserted into the first carrier member.

In accordance with one aspect of the present invention, in the one or more picking up and weighing steps and in the one or more inserting and weighing steps, a second and a third robotic arm of the apparatus alternately and cyclically move the first and second carrier member, respectively, in a picking up and inserting zone of the second station.

In particular, the first robotic arm picks up one or more containers, to-be-filled and to-be-weighed, from the second carrier member by means of a gripping member, and inserts the one or more containers, filled and weighed, into the first carrier member.

The picking up and inserting steps take place by means of the first gripping member in a common reference position located in the picking up and inserting zone.

In accordance with another aspect of the present invention, in the one or more picking up and weighing steps, the third arm cyclically moves the second carrier member into a plurality of operative pick-up positions at the picking up and inserting zone, so that one row at a time of housing seats of the second carrier member, in which one or more to-be-picked up containers are housed, is each time aligned vertically to the reference position. Moreover, in the one or more inserting and weighing steps, the second arm cyclically moves the first carrier member into a plurality of operative inserting positions at the picking up and inserting zone, so that one row at a time of housing seats of the first carrier member is each time aligned vertically to the reference position for the insertion of the one or more filled containers.

In accordance with another aspect of the present invention, the one or more picking up and weighing steps comprise each a respective first weighing sub-step wherein weighing means of the apparatus, which are placed at the reference position, weigh the one or more to-be-filled containers before these are picked up from the second carrier member in order to be filled. Furthermore, the one or more inserting and weighing steps comprise each a respective second weighing sub-step wherein the weighing means weigh the one or more filled containers before these are totally inserted into the first carrier member.

In accordance with another aspect of the present invention, in the weighing sub-steps, a weighing device of the weighing means, which is aligned vertically to the reference position, is raised passing from a lowered position to a raised position in order to cooperate with one or more containers at a time, temporarily placed above it, weighing them both prior to completely picking them up from the second carrier member and also before totally inserting them into the first carrier member. In the raised position, the weighing device raises or maintains in a lifted position also the one or more containers.

In accordance with another aspect of the present invention, in the one or more picking up and weighing steps, during the raising of the weighing device from the lowered position to the raised position, a lower part of the one or more to-be-picked up containers enters into a corresponding weighing seat of the weighing device, so as to contact a load cell present in the weighing seat. Furthermore, in the one or more inserting and weighing steps, the weighing device is in the raised position and before the one or more filled containers are totally inserted into the first carrier member, the lower part of the one or more containers enters into the corresponding weighing seat so as to contact the load cell. In this configuration, the containers rest only on this load cell, so as to guarantee a reliable and precise weighing.

In accordance with another aspect of the present invention, in the one or more picking up and weighing steps, the first robotic arm picks up the one or more containers starting from a first row of the second carrier member and brings them to a filling zone of the second station without operating, or moving, above yet to-be-picked up and yet to-be-filled containers. In addition, in the one or more inserting and weighing steps, the first arm inserts the one or more containers starting from a last row of the first carrier member without operating, or moving, above already filled containers.

The present invention also concerns an apparatus for automatically filling and weighing containers supported by corresponding carrier members, wherein the apparatus at least comprises: a first station for feeding the carrier members sequentially; a second station comprising a picking up and inserting zone of the containers, and arranged for filling and weighing the containers; a first robotic arm configured to selectively move one at a time the carrier members from the first station to the second station.

In accordance with another aspect of the present invention, the apparatus further comprises a second and a third robotic arm placed at the second station and configured to receive at least a first and a second carrier member, respectively, from the first robotic arm and to move them between one or more operative positions. Specifically, the first carrier member is configured to support filled and weighed containers and the second carrier member is configured to support to-be-filled and to-be-weighed containers.

Moreover, the second station comprises a picking up and inserting zone of the containers.

In particular, the second and third robotic arm are configured to alternately and cyclically move the first and second carrier member in the picking up and inserting zone, and the first robotic arm comprises a first gripping member configured to pick up one or more to-be-filled and to-be-weighed containers from the second carrier member, and to insert the one or more filled and weighed containers into the first carrier member. The pick-up and insertion takes place at a common reference position located in the picking up and inserting zone.

In accordance with another aspect of the present invention, the third arm is able to cyclically move the second carrier member into a plurality of operative pick-up positions at the picking up and inserting zone, so that one row at a time of housing seats of the second carrier member, in which one or more to-be-filled containers are housed, is aligned vertically to the reference position.

In addition, the second arm is able to cyclically move the first carrier member into a plurality of operative inserting positions at the picking up and inserting zone, so that one row at a time of housing seats of the first carrier member is aligned vertically to the reference position for the insertion of the one or more filled containers.

In accordance with another aspect of the present invention, the apparatus is provided with weighing means placed in the picking up and inserting zone and comprising at least one weighing device for weighing the one or more containers. Specifically, the weighing device has a weighing arm provided with weighing seats which are aligned vertically and coaxial to the reference position and have the function of accommodating the one or more containers.

In accordance with another aspect of the present invention, the weighing device is positioned below a movement plane of the carrier members and is configured to selectively raise and lower in order to pass from a lowered position to a raised position and vice versa.

In accordance with another aspect of the present invention, the first robotic arm is also able to move the one or more containers in order to pick them up from the second carrier member and transfer them towards a filling zone, and to transfer them from the filling zone into the first carrier member.

In accordance with another aspect, the first robotic arm comprises a second gripping member configured to grip the carrier members.

In accordance with another aspect, the first gripping member is provided with a plurality of seats placed along a line and configured to withdraw and temporarily support the containers.

In accordance with another aspect, the apparatus further comprises a filling device configured to dispense a liquid product into the containers. The filling device is placed in the second station.

In accordance with another aspect, the filling device is mounted on a fourth robotic arm.

DESCRIPTION OF THE DRAWINGS

These and other aspects, characteristics and advantages of the present invention will become apparent from the following description of some embodiments, given as a non-restrictive example with reference to the attached drawings wherein.

Figure 1:
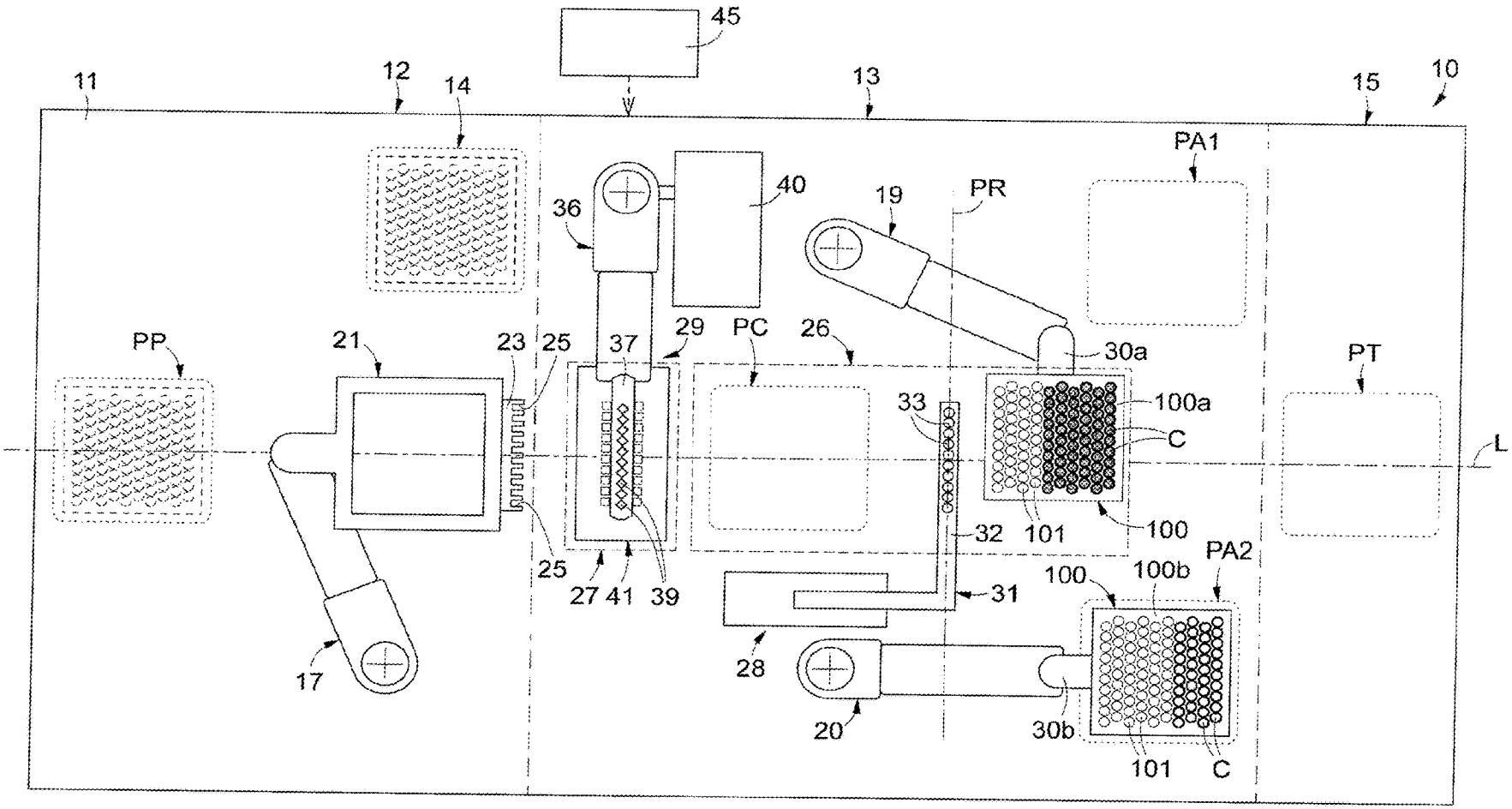
FIG. 1 is a schematized and simplified top view of an apparatus according to the present invention, for automatically filling and weighing containers.

We must clarify that the phraseology and terminology used in the present description, as well as the figures in the attached drawings also in relation as to how described, have the sole function of better illustrating and explaining the present invention, their purpose being to provide a non-limiting example of the invention itself, since the scope of protection is defined by the claims.

To facilitate comprehension, the same reference numbers have been used, where possible, to identify identical common elements in the drawings. It is understood that elements and characteristics of one embodiment can be conveniently combined or incorporated into other embodiments without further clarifications.

DESCRIPTION OF SOME EMBODIMENTS OF THE PRESENT INVENTION

With reference to FIG. 1, an apparatus 10 according to the present invention is suitable and usable for automatically filling and weighing containers C along a work path L. In the embodiment shown here, the work path L is rectilinear, but in other embodiments, not shown in the drawings, it could assume any suitable trajectory, even curved and/or fragmented or mixed.

The containers C can be of any shape and size, and they can be, without limitation to generality, vials, bottles, flasks, or other types of containers, capable of containing either fluid products P, in particular liquids, or solid, powder, or gel products P.

The containers C are supported by respective carrier members, or trays, 100 with a substantially parallelepiped shape, which are provided with a plurality of circular and through housing seats 101, each suitable to stably, although temporarily, support a respective container C. In particular, the housing seats 101 are placed according to a positioning matrix consisting of a plurality of rows and columns, such as to form a series of rows F (from F1 to FU) parallel to each other, reciprocally offset and distanced. We must clarify that, depending on the orientation of the tray 100 with respect to the direction of the work path L (FIG. 1), the term "row" can be understood as any line, or column, of the aforementioned positioning matrix. Furthermore, we must clarify that the term "row" F, unless otherwise specified, refers to the orderly arrangement of the housing seats 101, and therefore, consequently, of the containers C placed therein.

The apparatus 10 comprises a base 11 (FIG. 1) on which there are arranged in sequence, from left to right in FIG. 1, along the work path L: a first station 12, or feeding station, in which the trays 100, possibly each containing a respective plurality of still empty containers C, are fed and withdrawn from a withdrawal position PP; a second station 13 configured to carry out the filling and weighing of the containers C, moving them between several operative zones and/or positions; and a third station 15 in which the filled and weighed containers C are closed at a closing position PT, in order to then be sent towards a subsequent distribution and/or boxing zone, for example towards other work apparatuses or stations, not shown in the drawings.

Both the first station 12 and also the third station 15, which are indicated and delimited with dashed lines in FIG. 1, can be of any known type whatsoever.

Furthermore, between the first and second station 12 and 13 there can also be an emptying zone 14, in which one tray 100 at a time can be positioned, the tray 100 provided for example with containers C, which has to be emptied for its subsequent use.

Along the work path L, each tray 100 is moved by means of a plurality of movement means which comprise at least a first robotic arm 17 configured to selectively move one at a time the trays 100 from the first station 12 to the second station 13; a second robotic arm 19 and a third robotic arm 20, each configured to receive a respective carrier member, or tray 100*a*, 100*b* from the first robotic arm 17 and to move it between one or more operative positions within the second station 13, as will be described in detail below. Specifically, one of such trays 100*a* has the function of supporting filled and weighed containers C, and the other 100*b* has the function of supporting to-be-filled and to-be-weighted containers C.

We must clarify that the by term "robotic arm" and its declinations, here and hereafter in the description and in the attached claims we mean, without any limitations to generality, anthropomorphic articulated arms, six-axis robotic arms, SCARA (Selective Compliant Articulated Robot Arm) systems, r-theta robots and units of linear actuators and rotary actuators, or combinations thereof. In the example given here, the robotic arms are preferably robotic arms with six axes of rotation, having a rest base, a plurality of reciprocally articulated segments and a gripping head, for example provided with grippers or similar suitable gripping tools.

In the embodiment shown here, the first robotic arm 17 is placed at the first station 12, close to the second station 13, while the second and third arm 19 and 20 are placed inside the second station 13.

In particular, the first robotic arm 17 is able to perform at least a first programmed function to move one tray 100 at a time from the withdrawal position PP to a delivery position PC at the second station 13. Optionally, the first robotic arm 17 is able to perform a second programmed function to move a tray 100 also at the emptying zone 14 for its subsequent emptying.

The first robotic arm 17 comprises a first gripping member 23 configured to pick up one or more containers C, to-be-filled and to-be-weighed, from the second carrier member 100*b*, and to insert the one or more containers C, filled and weighed, into the first carrier member 100*a*.

Moreover, the first robotic arm 17 also comprises a second gripping member 21 configured to grip the carrier members 100.

The first gripping member 23 can be attached to the second gripping member 21, preferably in a front position, to allow the pick-up of the containers C.

Specifically, the first robotic arm 17 is provided, at a respective end, with a gripping support defining the second gripping member 21 which has respective gripping means, which are defined by two or more sucker members capable of selectively taking and raising each tray 100.

The first gripping member 23, preferably defined by a front comb member, is provided with a plurality of gripping seats, or seats, 25, placed along a line and configured to withdraw and temporarily support corresponding containers C to-be-moved. We must clarify that the number of gripping seats 25 is preferably equal to the number of housing seats 101 present on each row F of the trays 100.

Specifically, the first robotic arm 17, by means of the first gripping member 23, is able to perform a third programmed function to move one or more containers C of one row F at a time, to allow both their filling and also their weighing, as will be described in detail below. Possibly, the first robotic arm 17, always by means of the first gripping member 23, is also able to perform a further programmed function to empty a tray 100, provided with containers C, when the latter is in the emptying zone 14.

The second station 13 comprises at least one picking up and inserting zone 26 of the containers C, close to which the second and third robotic arm 19 and 20 are placed close to, and a filling zone 27 adjacent to the picking up and inserting zone 26.

As can be observed in FIG. 1, the filling zone 27 is placed upstream of the picking up and inserting zone 26 with reference to the operative flow of the containers C along the work line L. In addition, the delivery position PC of the trays 100 with the to-be-filled containers is located inside the picking up and inserting zone 26 and is substantially centered with respect to the work line L.

The second station 13, in addition to the two robotic arms 19 and 20, is provided both with weighing means 28, which are configured to weigh the containers C before and after filling and which are placed in the picking up zone 26 at a reference position PR, and also with filling means, hereafter defined by a filling device 29 which is configured to fill the containers C and which can be selectively positioned at the filling zone 27.

In accordance with one aspect of the present invention, the second and third robotic arm 19 and 20 are able to perform at least one respective programmed function to alternately and cyclically move the respective trays 100*a*, 100*b* at the picking up and inserting zone 26, so that the picking up of one or more containers C, to-be-filled and to-be-weighed, from the respective tray 100*b* and the insertion of these one or more containers C, filled and weighed, into the other tray 100*a* occur at the reference position PR. This implies that the picking up and inserting of the one or more containers C is performed at the weighing means 28.

In particular, the second robotic arm 19 and the third robotic arm 20 are mounted on the base 11 from opposite sides with respect to the work path L, and are positioned so as to alternatively cooperate, from opposite sides, with the first robotic arm 17 both for the receiving and moving of the respective trays 100*a* and 100*b*, and also for the picking up and inserting of the containers C.

Furthermore, the second and third robotic arm 19 and 20 are provided with a respective movement member, or support, 30*a* and 30*b* (FIGS. 1 to 8) configured to support each tray 100 during the corresponding movement inside the second station 13. Specifically, each movement support 30*a* and 30*b* is provided with a plurality of through seats coaxial to the housing seats 101 of each tray 100.

In accordance with another aspect of the present invention, the second robotic arm 19 is capable of cyclically moving, by means of a roto-translational movement parallel to the base 11, the respective tray 100*a*. In particular, the second robotic arm 19 is capable of moving the carrier member 100*a* from the delivery position PC to a first waiting position PA1 (FIG. 1), in which the tray 100*a* is substantially outside the picking up and inserting zone 26, and from that first waiting position PA1 to a plurality of operative inserting positions $POI_i$, in which the respective tray 100*a* is placed in the picking up and inserting zone 26 so that each time, that is, in each operative inserting position $POI_i$, one row F of housing seats 101 of the tray 100*a*, starting from the last row FU, is aligned vertically to the reference position PR for the insertion of one or more filled containers C.

In accordance with another aspect of the present invention, the third robotic arm 20 is able to perform a respective programmed function to cyclically move, by means of a roto-translational movement parallel to the base 11, the respective carrier member 100*b*. In particular, the third robotic arm 20 is capable of moving the carrier member 100*b* from the delivery position PC to a second waiting position PA2, substantially symmetrical with respect to the first waiting position PA1 with reference to the work line L, and from that second waiting position PA2 to a plurality of operative pick-up positions $POE_i$, in which the respective tray 100*b* is placed in the picking up and inserting zone 26 so that each time, that is, in each operative pick-up position $POE_i$, one row F of housing seats 101 of the tray 100*b*, starting from the first row F1, is aligned to the reference position PR for the picking up of one or more to-be-filled containers C.

We must clarify that the movement of the trays 100 by means of the second and third arm 19 and 20 takes place on a movement plane PM (FIGS. 2 to 8) parallel to the base 11 and distanced with respect to the latter.

The weighing means 28 (FIG. 1) comprise at least one weighing device 31 (FIGS. 1 to 8) having a weighing arm 32 perpendicular to the work line L and provided with a plurality of weighing seats 33 for accommodating and weighing the containers C of a respective row F. The weighing seats 33 are equal in number to the number of housing seats 101 of each row F and are provided, on the bottom, with a respective load cell 35 for weighing the containers C.

In particular, the weighing device 31 is positioned below the movement plane PM of the trays 100 and the weighing seats 33 of the weighing arm 32 are aligned vertically to the reference position PR. In this way, when the trays 100*b* and 100*a* are brought by the second and third arm 19, 20 into the different operative pick-up $POE_i$ and inserting POI; positions, the housing seats 101 of the trays 100*a* and 100*b* are each time aligned coaxially to the weighing seats 33 of the weighing device 31 and therefore to the containers C, if present.

In accordance with one aspect of the present invention, the weighing device 31 is configured to selectively raise and lower from a lowered position P1 to a raised position P2 (FIGS. 2 to 8), and vice versa, in order to cooperate with the containers C present in a row F of housing seats 101 of the trays 100. In particular, in the lowered position P1 the weighing arm 32 is in a position such as to not interfere with the containers C placed in the trays 100; in the raised position P2, on the other hand, the weighing arm 32 is able to cooperate with the containers C of a certain row F in order to raise and weigh them during pick-up from the tray 100*b* held by the third robotic arm 20, and to support them, weigh them, and then lower them during insertion into the tray 100*a* held by the second robotic arm 19. We must clarify that when the weighing arm 32 of the weighing device 30 is in the raised position P2, the containers C are raised from the housing seats 101 in order to allow their pick-up or insertion, by means of the first gripping member 23 of the first robotic arm 17.

In accordance with one embodiment of the present invention, in which the product P is liquid, the filling device 29 (FIG. 1) comprises, or is mounted on, a fourth robotic arm 36, at one end of which there is placed a dispensing member, or dispensing head 37, having a plurality of dispensing nozzles 39 and configured to sequentially fill one row F of containers C at a time. Furthermore, the filling device 29 comprises a pumping and feeding unit 40 operatively connected to the dispensing head 37 for pumping and feeding the liquid product P towards the latter, . . . as will be described in detail below.

At the filling zone 27 there is also a holding member 41 provided with a plurality of holding seats 42, equal in number to the number of housing seats 101 of each tray 100. The holding seats 42 are configured to temporarily house the containers C picked-up by means of the first robotic arm 17 from the tray 100*b* held by the third robotic arm 20 and ready for the corresponding filling.

The apparatus 10 further comprises programmable-type electronic control means 45, which comprise at least one central control unit and which are configured to control the activation and the spatial and temporal movements of the movement means, that is, of the first, second and third robotic arm 17, 19 and 20 for the performance of the respective programmed functions.

The programmable-type electronic control means 45 are also configured to control the activation and the spatial and temporal movements of the weighing means 28 and of the filling device 29.

In particular, the second and third robotic arm 19 and 20 are controlled by the electronic control means 45 in such a way that each of them makes each of the trays 100*a* and 100*b* follow substantially similar trajectories, specular and temporally offset, so that the second and third robotic arm 19, 20 do not interfere with each other, despite working on the same work plane M.

The operation of the apparatus 10 described heretofore, which corresponds to the method according to the present invention, comprises the steps described below.

Firstly, however, for a clear disclosure, we must clarify that here we have described the work steps relating to the containers C of the two trays 100 fed and withdrawn one after the other, in particular a first tray 100*a* and a second tray 100*b*, respectively, it being understood that this order, or the operative steps relating to one and/or the other, are not intended as a limitation and that all the other trays 100 are then subjected cyclically to the same work.

In a first feeding step, a first empty tray 100*a* is fed at the withdrawal position PP of the first station 11.

In a first withdrawing step, the first robotic arm 17, by means of the second gripping member 21, withdraws the first empty tray 100*a*, moving it towards the delivery position PC at the second station 13.

If necessary, an emptying step is provided in which, before delivering the tray 100*a* to the delivery position PC, the first robotic arm 17 positions the tray 100*a* in the emptying zone 14 and, by means of the first gripping member 23, picks up one row F of containers C at a time in order to empty the first tray 100*a*, leaving the corresponding housing seats 101 free.

At the second station 13, in a first movement step the second robotic arm 19 is driven in order to be positioned in the delivery position PC of the picking up and inserting zone 26, so as to receive the empty first tray 100*a* from the first robotic arm 17, and then transfer it to the first waiting position PA1.

During the first step of moving the second robotic arm 19, a second feeding step begins in which a second tray 100*b*, on which a plurality of to-be-filled containers C is placed, is fed at the first station 12.

Then, once the empty first tray 100*a* has been delivered, a second withdrawing step begins, in which the first robotic arm 17 withdraws the second tray 100*b* with the respective to-be-filled containers C from the withdrawal position PP.

At the second station 13, in a second movement step the third robotic arm 20 is driven in order to be positioned in the delivery position PC so as to receive the second tray 100*b* from the first robotic arm 17, and then transfer it towards the reference position PR.

In accordance with another aspect of the present invention, the method comprises one or more movement steps, one or more weighing and picking up steps, and one or more inserting and weighing steps, in which the second and third arm 19 and 20, with a roto-translational motion on a movement plane PM parallel to the base 11 (FIGS. 9 to 23), alternately and cyclically move the respective trays 100*a*, 100*b* in the picking up and inserting zone 26 so that the pick-up of one or more containers C, to-be-filled and to-be-weighed, from the carrier member 100*b* held by the third robotic arm 20, and the insertion of said one or more containers C, filled and weighed, into the other carrier member 100*a* held by the second robotic arm 19 occur at the common reference position PR.

Figure 9:
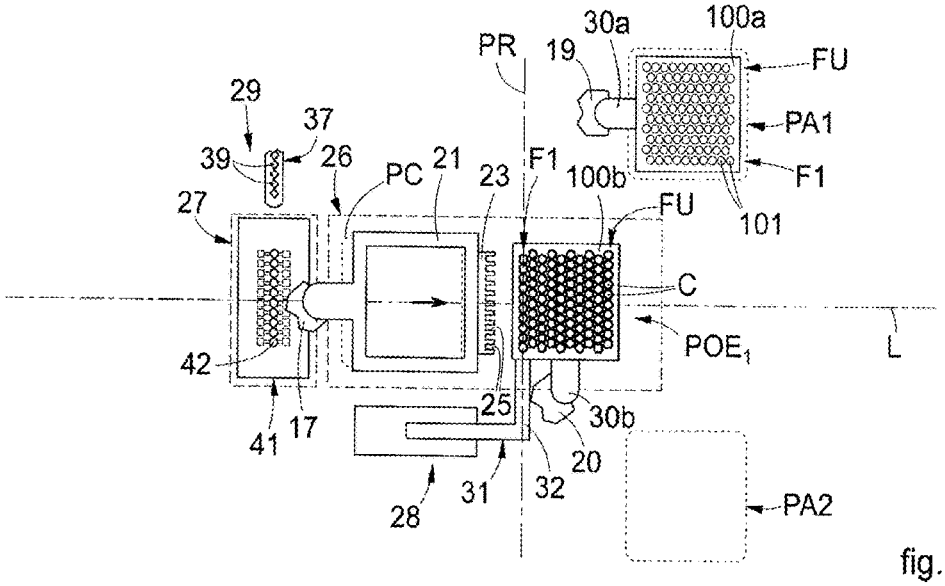
FIGS. 9 to 23 are schematized and simplified top views of an operative sequence of multiple picking up and weighing steps and multiple inserting and weighing steps.
Figure 10:
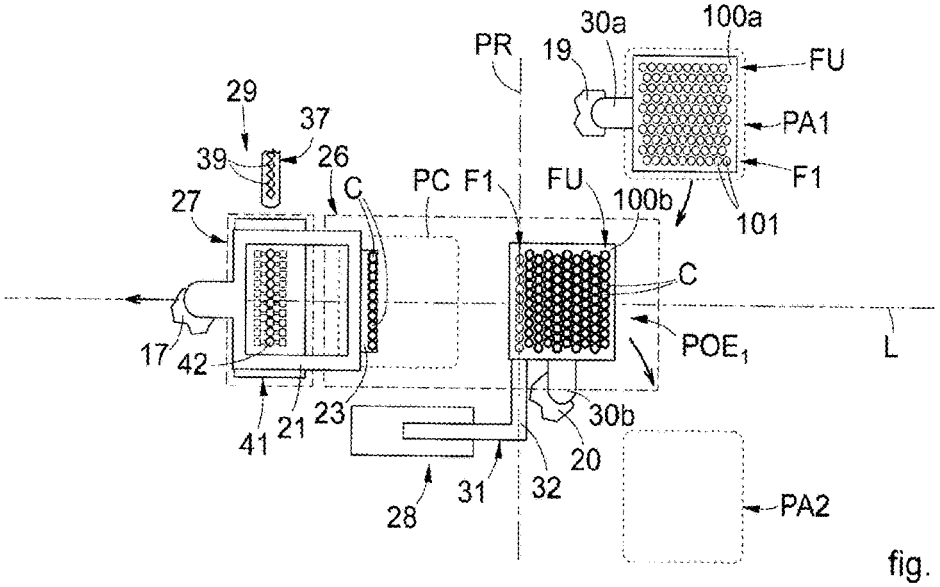
Figure 11:
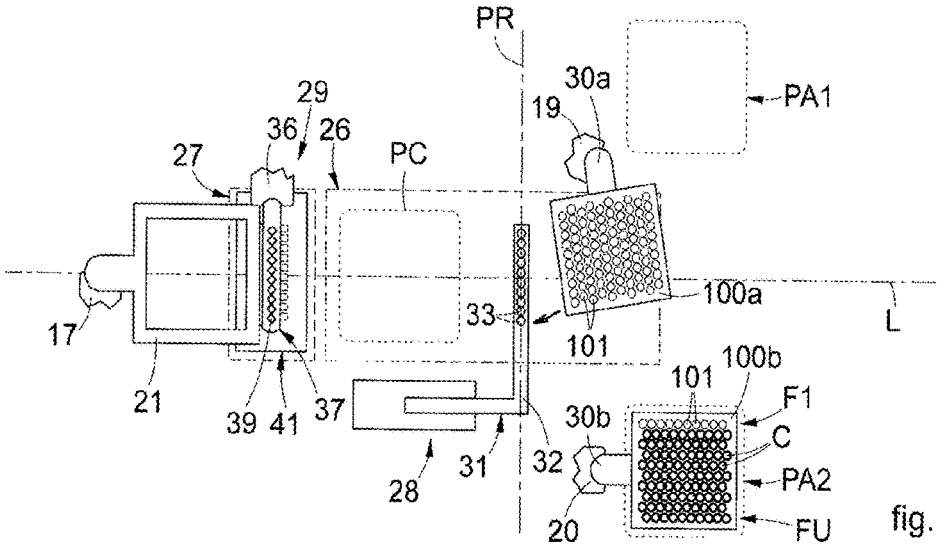
Figure 12:
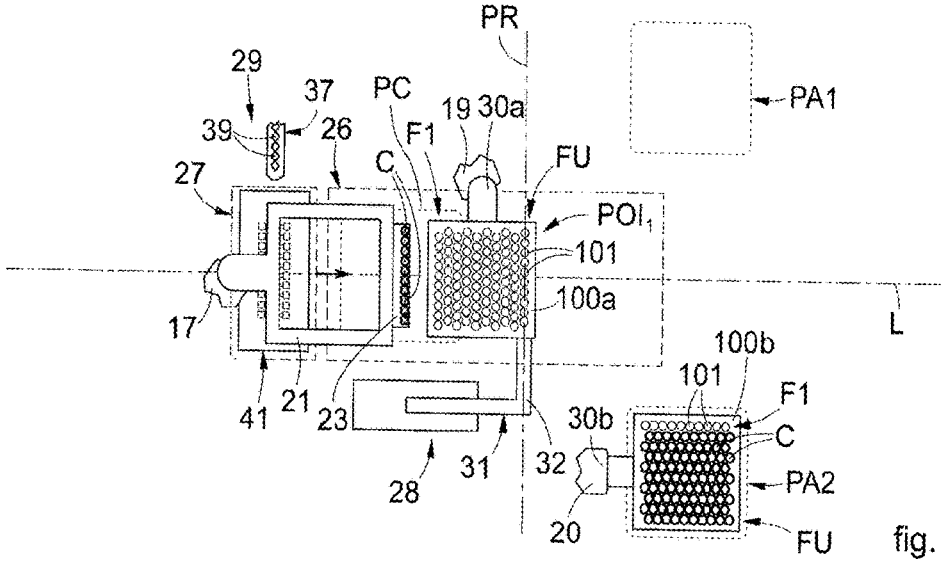
Figure 13:
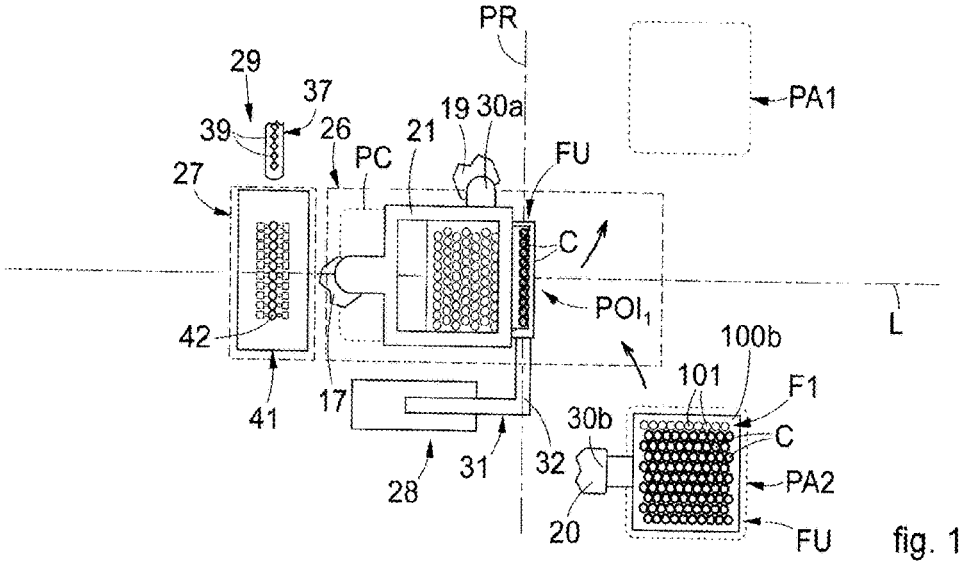
Figure 14:
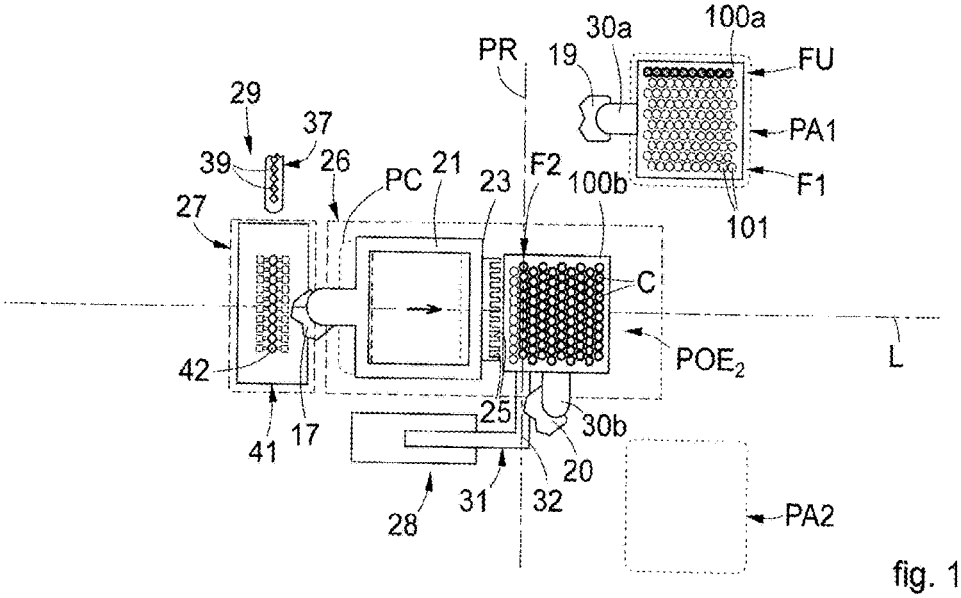
Figure 15:
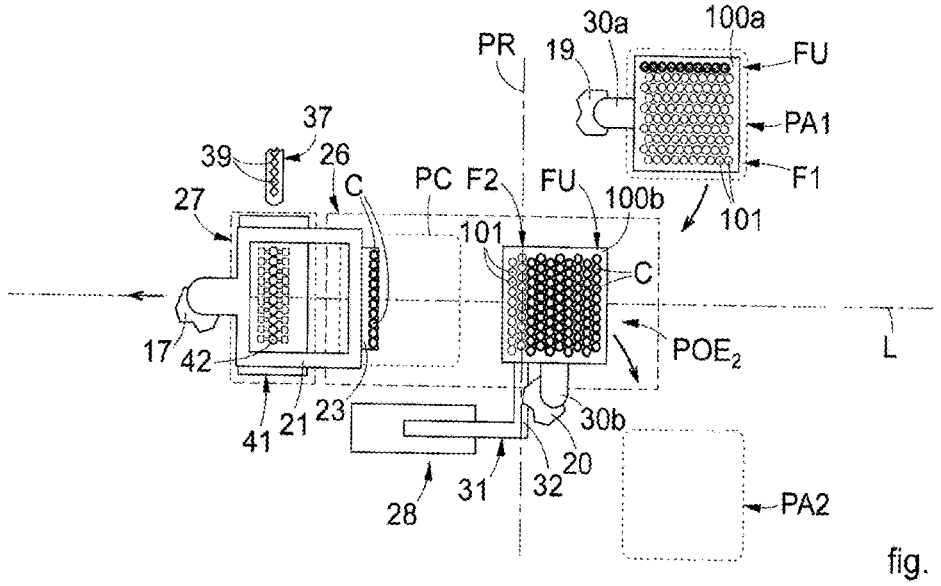
Figure 16:
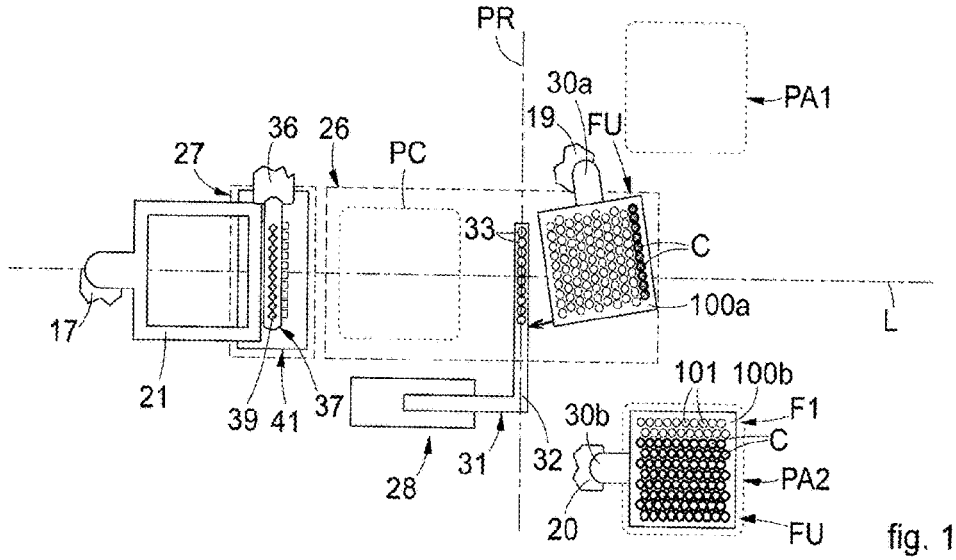
Figure 17:
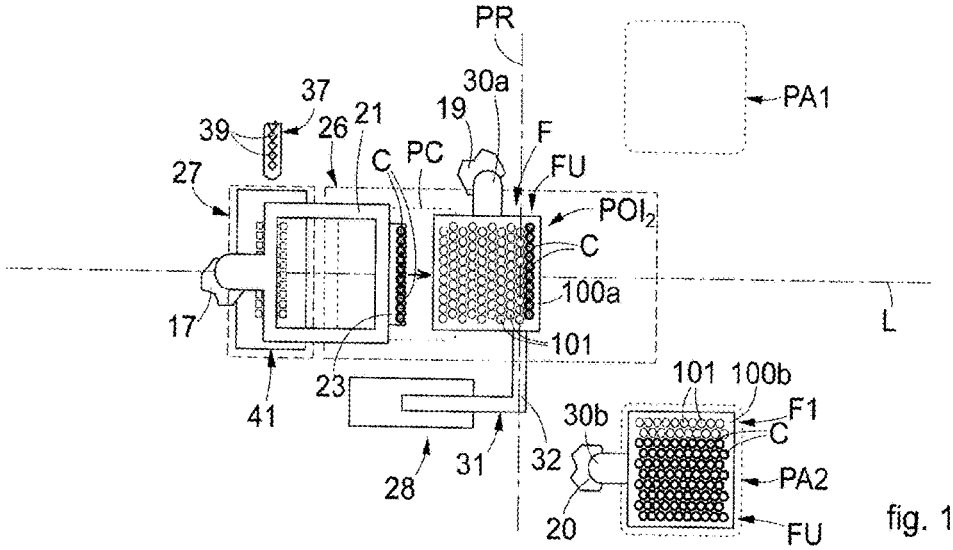
Figure 18:
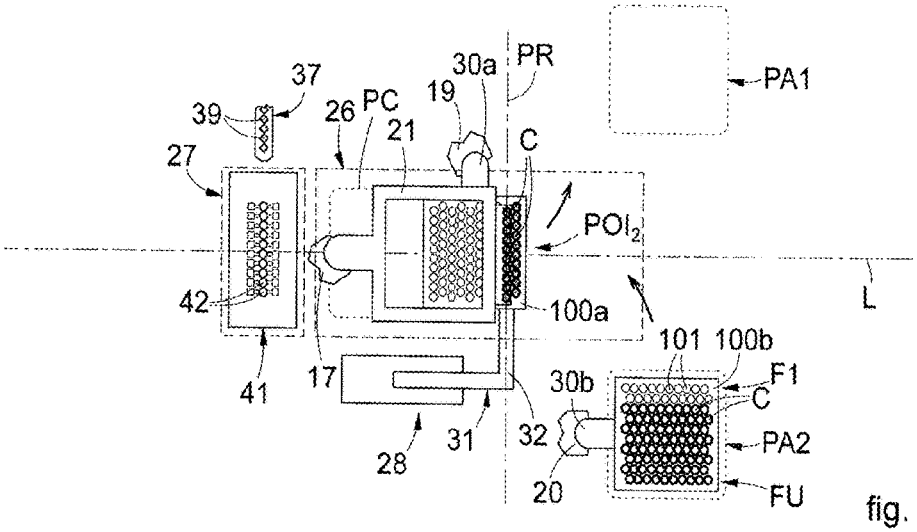
Figure 19:
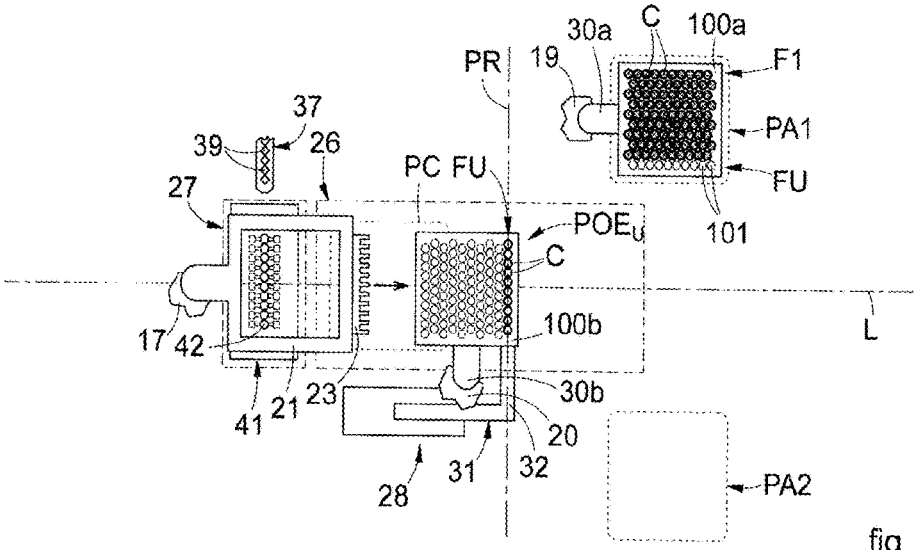
Figure 20:
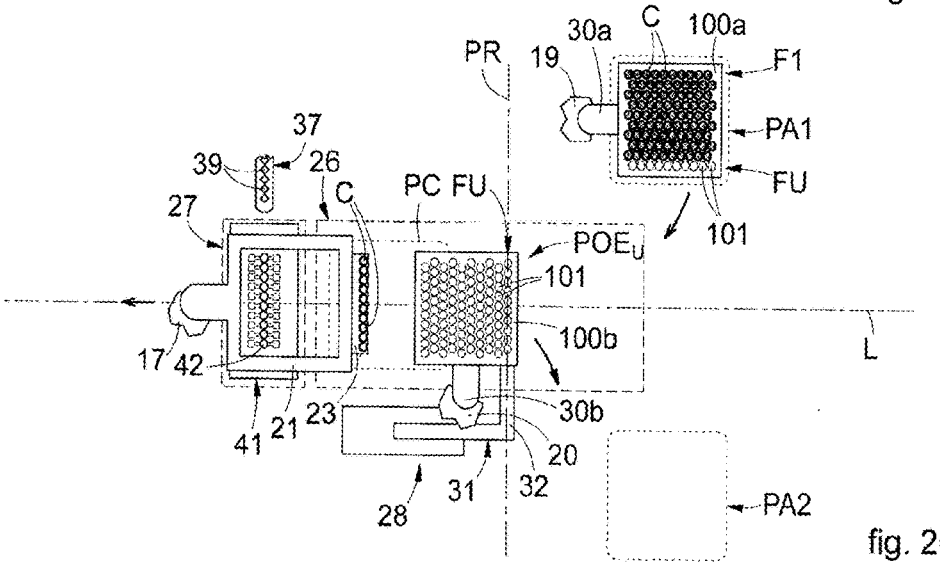
Figure 21:
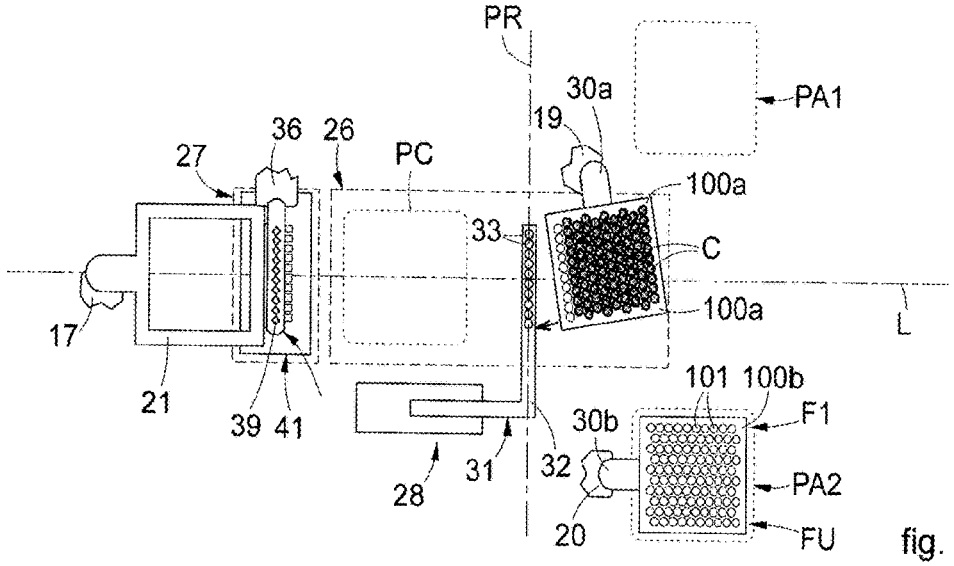

In particular, in a first weighing and picking up step, initially the third robotic arm 20 translates horizontally on the movement plane PM to bring the first row F1 of containers C of the second tray 100*b* at the reference position PR, so as to overlap the housing seats 101 of the first row F1, and therefore the containers C of the first row F1, with the weighing seats 33 of the weighing device 31. In this position, the second tray 100*b* is in a first operative pick-up position $POE_1$ (FIG. 9).

We must clarify that the first operative pick-up position $POE_1$ is the first of the generic operative pick-up positions $POE_i$ as described above.

Then, in a first weighing sub-step, the weighing device 31 passes from the lowered position P1 (FIG. 2) to the raised position P2 (FIG. 3) in order to weigh the empty containers C, raising them from their housing position on the tray 100*b* into a lifted position, and preparing them for the respective pick-up by the first robotic arm 17. In particular, while the weighing device 31 is raised from the lowered position P1 to the raised position P2, the lower part of each container C is inserted into a corresponding weighing seat 33 so as to come into contact with the load cell 35 placed on the bottom of weighing seat 33.

Figure 5:
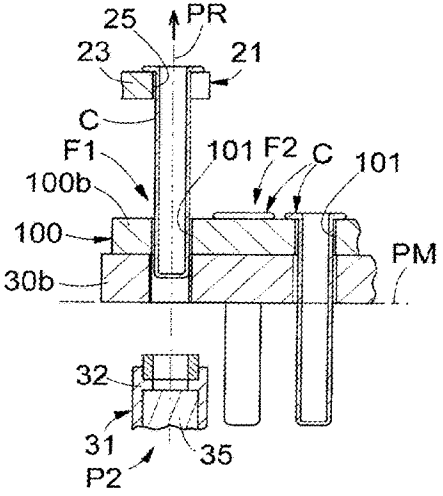
FIGS. 2 to 5 are schematic lateral views of a step of picking up and weighing the empty containers.
Figure 4:
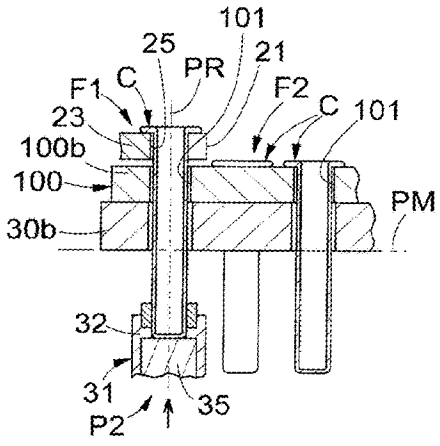
Figure 3:
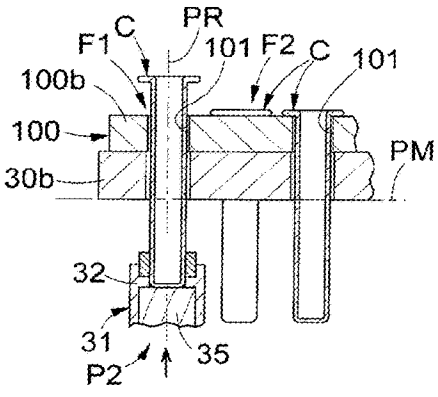
Figure 2:
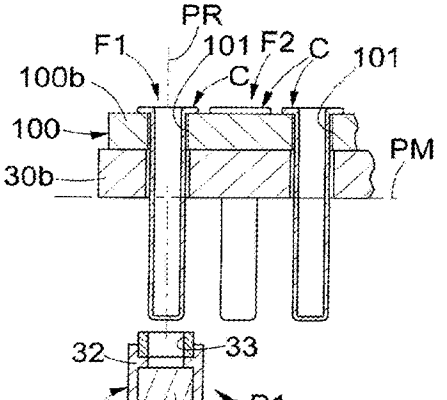

Subsequently, in a first picking up sub-step (FIG. 10), the first robotic arm 17, by means of the first gripping member 23, approaches the reference position PR and picks up the empty containers C present in the first row F1 and already weighed, in order to bring them at the filling zone 27 (FIGS. 4 and 5).

In a first filling step (FIG. 11), the picked-up empty containers C are positioned inside the holding seats 42 of the holding member 41 and the fourth robotic arm 36, by means of the dispensing nozzles 39, dispenses a certain quantity of liquid inside the containers C.

During the first filling step, the third arm 20 transfers the second tray 100*b* from the first operative pick-up position $POE_1$, in which the first row F1 of empty containers C has been picked up, to the respective second waiting position PA2.

Then, a first inserting and weighing step begins (FIG. 12), in which the second robotic arm 19 transfers the first tray 100*a* inside the picking up and inserting zone 26 at the reference position PR, so that the housing seats 101 of the last row FU (the one furthest away from the filling zone 27)

of the first tray 100*a* are aligned coaxially to the weighing seats 33 below. In this position, the first tray 100*a* is in a first operative inserting position $POI_1$.

We must clarify that the first operative inserting position $POI_1$ is the first of the generic operative inserting positions $POI_i$ as described above.

Please note that in this first inserting and weighing step the weighing device 31 is in the raised position P2.

Figure 7:
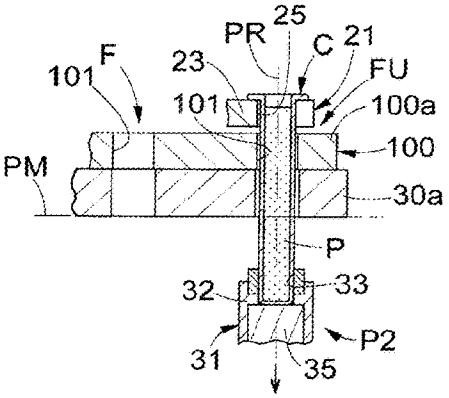
Figure 6:
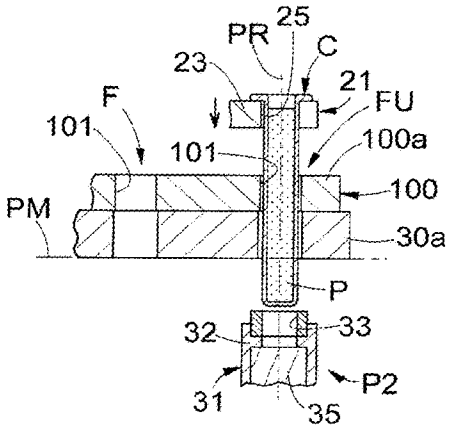

In a first inserting sub-step, the first arm 17 (FIG. 13) brings the filled containers C at the reference position PR and inserts them in the housing seats 101 of the last row FU of the first tray 100*a* held by the second robotic arm 19. In this sub-step, the containers C, filled, are sustained, or supported, by the weighing device 31; in fact, the lower part of the containers C passes through the housing seats 101 and is inserted into the corresponding weighing seats 33 to come into contact with the load cells 35 (FIGS. 6 and 7).

Figure 8:
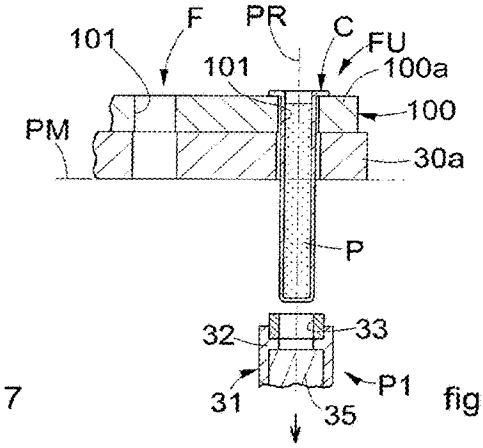
FIGS. 6 to 8 are schematic lateral views of a step of inserting and weighing the filled containers.

There is then a second weighing sub-step, in which the weighing device 31 weighs the filled containers C and is subsequently lowered into the lowered position P1, consequently also lowering the containers C until they assume a normal housing position on the first tray 100*a* (FIG. 8).

Subsequently, the second robotic arm 19 transfers the first tray 100*a* from the first operative inserting position $POI_1$ into the respective first waiting position PA1.

A second picking up and weighing step is then performed (FIG. 14), in which the third robotic arm 20 transfers the second tray 100*b* into the picking up and inserting zone 26 at the reference position PR in order to make it assume a second operative pick-up position $POE_2$, that is, so that the housing seats 101 of a second row F2 of the second tray 100*b* are aligned coaxially to the weighing seats 33 below. Please note that in this sub-step the weighing device 31 is in the lowered position P1.

Another first weighing sub-step then begins, the same as the previous one, which this time involves the second row F2 of to-be-filled containers C.

Therefore, a second picking up step (FIG. 15) and a second filling step (FIG. 16) are carried out, which are the same as those described above, but with reference to the second row F2 of containers C picked up from the second tray 100*b*.

In general, in the picking up and weighing steps, the third arm 20 cyclically moves the second tray 100*b* into a plurality of operative pick-up positions POE; at the picking up zone 26, so that one row F of housing seats 101 of the second tray 100*b*, in which the to-be-picked up empty containers C are present, is each time aligned vertically to the reference position PR above the weighing seats 33.

In particular, the picking up of the to-be-filled containers C, present in the second tray 100*b*, occurs without the first robotic arm 17 operating, or moving, above the yet to-be-picked up containers C. In fact, the first robotic arm 17 cyclically picks up the containers C starting from the first row F1 (the one closest to the filling zone 27) and, once they have been picked up, translates backwards in order to bring them into the filling zone 27. In this way, there is the advantage that the cyclic pick-ups of the containers C occur by operating above the already emptied housing seats 101, preventing any particles of dust and/or particulate from falling on the yet to-be-filled containers C.

Once the second filling step has been performed, a second inserting and weighing step begins (FIG. 17), in which the second robotic arm 19 transfers the first tray 100*a* into the picking up and inserting zone 26 at the reference position PR in order to make it assume a second operative inserting position $POI_2$, that is, so that the housing seats 101 of the penultimate row F of the first tray 100*a* are aligned coaxially to the weighing seats 33 below. Please note that in this sub-step the weighing device 31 is in the raised position P2.

A second inserting sub-step (FIG. 18) and a second weighing sub-step are then performed, the same as the previous ones, but with reference to the penultimate row F of containers C of the first tray 100*a*.

In general, in the inserting and weighing steps, the second arm 19 cyclically moves the first tray 100*a* into a plurality of operative inserting positions POI; at the picking up zone 26, so that one row F of housing seats 101 of the first tray 100*a* is each time aligned vertically to the reference position PR for the insertion of the already filled containers.

In particular, the insertion of the already filled containers C into the first tray 100*a* carried out by the first robotic arm 17 occurs without the first robotic arm 17 operating, or moving, above the already filled containers C placed on the first tray 100*a*. In fact, the first robotic arm 17 inserts the containers C cyclically, starting from the last row FU of the first tray 100*a* and, in order to do so, it advances from the filling zone 27 to the reference position PR by operating above the yet to-be-occupied housing seats 101. In this way, there is the advantage that the cyclic insertions of the containers C occur preventing any particles of dust and/or particulate from falling on the already filled containers C.

Figure 22:
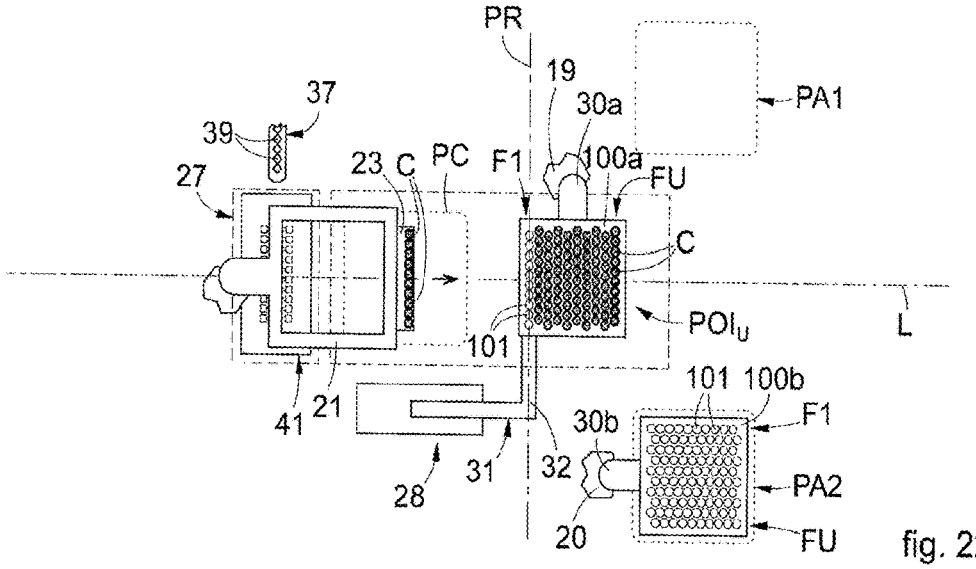
Figure 23:
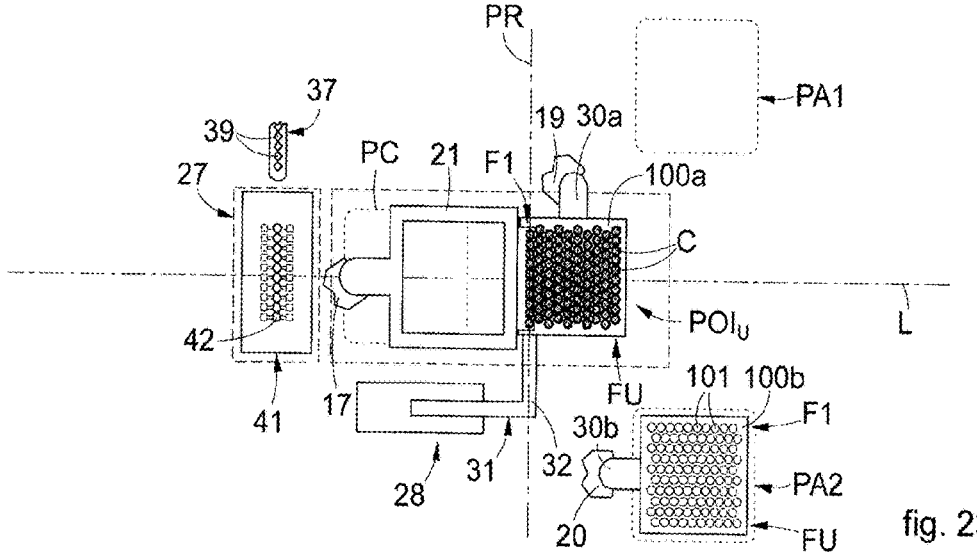

Then, other picking up and weighing steps, filling steps and inserting and weighing steps are repeated cyclically, as well as other movement steps until the last cycle of operations is completed, in which the second tray 100*b* is temporarily brought into the last operative pick-up position $POE_U$ to pick up the containers C from the last row FU of the second tray 100*b* in order to fill them (FIGS. 19, 20 and 21), and in which the first tray 100*a* is temporarily brought to the last operative inserting position $POI_U$ to insert the filled containers C into the first row F1 of the first tray 100*a* (FIGS. 22 and 23).

In a final movement step, the second robotic arm 19 transfers the first tray 100*a* provided with the filled containers C towards the closing position PT of the third station 15 in order to close or cap the filled containers C.

Once the first tray 100*a* has been delivered at the third station 15, the second and third arm 19 and 20 can start another cycle of operations as described above; this cycle of operations begins with a third step of feeding another tray 100. In particular, the second tray 100*b*, once emptied, will be delivered to the second robotic arm 19 in order to become, and to perform the functions of, the first tray 100*a* to-be-filled, while a new second tray 100*b* will be delivered to the third robotic arm 20, full of containers C to-be-weighed, -picked up, -filled and -transferred into the tray carried by the second robotic arm 19.

We must clarify that the method can also provide possible steps of calibrating the weighing means 28 with weights of a known magnitude, which are usually performed after some operating cycles to verify the correct operation of the weighing instruments.

It is clear that modifications and/or additions of parts may be made to the apparatus 10 and to the method as described heretofore, without departing from the field and scope of the present invention, as defined by the claims.

It is also clear that, although the present invention has been described with reference to some specific examples, a person of skill in the art will be able to achieve other equivalent forms of apparatuses and methods for automatically filling and weighing containers, having the characteristics as set forth in the claims and hence all coming within the field of protection defined thereby.

In the following claims, the sole purpose of the references in brackets is to facilitate their reading and they must not be considered as restrictive factors with regard to the field of protection defined by the claims.

The invention claimed is:

1. Method for automatically filling and weighing containers supported by a carrier member which is fed to a first feeding station of a filling and weighing apparatus, said apparatus further comprising a second filling and weighing station, said method comprising at least a first and a second feeding step, wherein a first carrier member of said carrier members configured to support filled and weighted containers and a second carrier member of said carrier members configured to support to-be-filled and to-be-weighted containers are fed to said first station to then be moved one at a time by a first robotic arm towards said second station; one or more picking up and weighing steps, wherein one or more to-be-filled containers are picked up from said second carrier member; and one or more inserting and weighing steps, wherein one or more filled containers are inserted into said first carrier member, wherein said one or more picking up and weighing steps and in said one or more inserting and weighing steps, a second and a third robotic arm alternately and cyclically move respectively said first and second carrier member in a picking up and inserting zone of said second station, and in that said first robotic arm picks up one or more containers, to-be-filled and to-be-weighed, from said second carrier member by means of a first gripping member and inserts said one or more containers, filled and weighed, into said first carrier member, said picking up and inserting steps taking place by means of said first gripping member in a common reference position located in said picking up and inserting zone.

2. Method according to claim 1, wherein in said one or more picking up and weighing steps, said third arm cyclically moves said second carrier member into a plurality of operative pick-up positions at said picking up and inserting zone, so that one row at a time of housing seats of said second carrier member, in which one or more to-be-picked up containers are housed, is each time aligned vertically to said reference position, and in said one or more inserting and weighing steps, said second arm cyclically moves said first carrier member into a plurality of operative inserting positions in said picking up and inserting zone so that one row of housing seats of said first carrier member is each time aligned vertically to said reference position for the insertion of said one or more filled containers.

3. Method according to claim 1, wherein said one or more picking up and weighing steps comprise each a respective first weighing sub-step wherein weighing means of said apparatus, which are placed at said reference position, weigh said one or more to-be-filled containers before said to-be-filled containers are picked up with the first robotic arm from said second carrier member, and in that said one or more inserting and weighing steps comprise each a respective second weighing sub-step wherein said weighing means weigh said one or more filled containers when said filled containers are inserted into said first carrier member.

4. Method according to claim 3, wherein in said weighing sub-steps, a weighing device of said weighing means, which is aligned vertically to said reference position, is raised passing from a lowered position to a raised position to cooperate with one or more containers at a time, temporarily placed above it, weighing them both prior to picking them up from said second carrier member and also when inserting them into said first carrier member, and in said raised position, said weighing device raises or maintains in a lifted position said one or more containers.

5. Method according to claim 4, wherein in said one or more picking up and weighing steps, during the raising of said weighing device from said lowered position to said raised position, a lower part of said one or more to-be-picked up containers enters in a corresponding weighing seat of said weighing device so as to contact a load cell housed in said weighing seat.

6. Method according to claim 1, wherein in said one or more picking up and weighing steps, said first robotic arm picks up one or more of said containers from said second carrier member and brings them to a filling zone of said second station without operating, or moving, above yet to-be-picked up and yet to-be-filled containers, and in said one or more inserting and weighing steps, said first arm inserts said one or more containers without operating, or moving, above already filled containers.

7. Apparatus for automatically filling and weighing containers supported by corresponding carrier members, wherein said apparatus at least comprises: a first station for feeding said carrier members sequentially; a second station comprising a picking up and inserting zone of said containers, and arranged for filling and weighing said containers; a first robotic arm configured to selectively move one at a time said carrier members from said first station to said second station; said apparatus being further comprising a second and a third robotic arm placed in said second station and configured to receive respectively at least a first and a second carrier member of said carrier members from said first robotic arm and to move them between one or more respective operative positions, wherein said first carrier member is configured to support filled and weighed containers and said second carrier member is configured to support to-be-filled and to-be-weighed containers; and said second and third robotic arm are configured to alternately and cyclically move respectively said first and second carrier member in said picking up and inserting zone, and said first robotic arm comprises a first gripping member configured to pick up one or more to-be-filled and to-be-weighed containers from said second carrier member and to insert one or more filled and weighed containers into said first carrier member, said pick-up and insertion taking place at a common reference position located in said picking up and inserting zone.

8. Apparatus according to claim 7, wherein said third arm is configured to cyclically move said second carrier member into a plurality of operative pick-up positions in said picking up and inserting zone, so that one row at a time of housing seats of said second carrier member, in which one or more to-be-filled containers are housed, is aligned vertically to said reference position, and said second arm is configured to cyclically move said first carrier member into a plurality of operative inserting positions in said picking up and inserting zone, so that one row at a time of housing seats of said first carrier member is aligned vertically to said reference position for the insertion of said one or more filled containers.

9. Apparatus according to claim 7, further comprising weighing means comprising at least one weighing device for weighing said one or more containers, and said weighing device has a weighing arm provided with weighing seats which are aligned vertically and coaxial to said reference position and configured to support said one or more containers.

10. Apparatus according to claim 7, wherein said weighing device is positioned below a movement plane of said carrier members when these are moved by said second and third robotic arm and is configured to selectively raise and lower to pass from a lowered position to a raised position and vice versa.

11. Apparatus according to any claim 7, wherein said second station further comprises a filling zone in which one or more containers are filled, and said first robotic arm is further configured to move said one or more containers both to pick them up from said second carrier member and transfer them towards said filling zone, and also to transfer them from said filling zone into said first carrier member.

12. Apparatus according to claim 7, wherein said first robotic arm comprises a second gripping member configured to grip said carrier members.

13. Apparatus according to claim 7, wherein said first gripping member is provided with a plurality of seats placed along a line and configured to withdraw and temporarily support said containers.

14. Apparatus according to claim 7, further comprising a filling device configured to dispense a liquid product into the containers, said filling device being placed in said second station.

15. Apparatus according to claim 14, wherein said filling device is mounted on a fourth robotic arm.

* * * * *